US005215452A

United States Patent [19]

Yamamura et al.

[11] Patent Number: 5,215,452

[45] Date of Patent: Jun. 1, 1993

[54] COMPRESSOR HAVING AN OIL PUMP RING ASSOCIATED WITH THE ORBITING SHAFT

[75] Inventors: Michio Yamamura, Kusatsu; Shuichi Yamamoto, Otsu; Shigeru Muramatsu, Kusatsu, all of Japan

[73] Assignee: Matsushita Electric Industrial Co., Ltd., Osaka, Japan

[21] Appl. No.: 688,599

[22] PCT Filed: Nov. 2, 1990

[86] PCT No.: PCT/JP90/01418

§ 371 Date: Sep. 3, 1991

§ 102(e) Date: Sep. 3, 1991

[87] PCT Pub. No.: WO91/06770

PCT Pub. Date: May 16, 1991

[30] Foreign Application Priority Data

Nov. 2, 1989 [JP] Japan ..... 1-287016

[51] Int. Cl.[5] ..... F04C 18/04; F04C 29/02

[52] U.S. Cl. ..... 418/55.6; 418/88; 418/94

[58] Field of Search ..... 418/55.6, 88, 94

[56] References Cited

U.S. PATENT DOCUMENTS 4,552,518 12/1985 Utter ..... 418/97
4,898,521 2/1990 Sakurai et al. ..... 418/55.6
5,017,108 5/1991 Murayama et al. ..... 418/55.6

FOREIGN PATENT DOCUMENTS 55-64180 5/1980 Japan .
61-19803 5/1982 Japan .
58-15787 1/1983 Japan .
60-196091 10/1985 Japan .
62-87693 4/1987 Japan ..... 418/55.6
63-9692 1/1988 Japan .
1-177482 7/1989 Japan .

*Primary Examiner*—John J. Vrablik
*Attorney, Agent, or Firm*—Stevens, Davis, Miller & Mosher

[57] ABSTRACT

Bearing lubrication in a scroll compressor can be reliably effected at a sufficient flow rate independently of the flow rate of the lubricating oil supplied to the compression chambers 14 through the provision of a rotary-type displacement oil pump having a pump ring 25 which is adapted to orbit by the movement of the orbiting drive shaft 16. In addition, a lubricating oil sump and an oil intake passage communicating therewith are provided in close vicinity to the compression mechanism 2, thereby making it possible to operate the compressor without involving any backward flow of refrigerant gas in the oil feeding passage over a wide range of operating speed.

5 Claims, 7 Drawing Sheets

LIST OF REFERENCE NUMERALS IN THE DRAWINGS

2.....compression mechanism

14.....compression chambers

16.....orbiting drive shaft

25.....pump ring

COMPRESSOR HAVING AN OIL PUMP RING ASSOCIATED WITH THE ORBITING SHAFT

TECHNICAL FIELD

This invention relates to lubrication in a scroll compressor.

BACKGROUND ART

As prior-art examples of structures related to lubrication in a scroll compressor of the type in which the pressure on the discharge side acts on the electric motor, the lubricating oil sump, etc., reference will be made to Japanese Patent Publication No. 61-19803 (Lubricating Device in a Scroll Fluid Machine) and the specification of U.S. Pat. No. 4,552,518 (Scroll Machine). FIG. 1 shows the structure of the scroll compressor disclosed in Japanese Patent Publication No. 61-19803 mentioned above, which includes a closed container 101, which contains a compression mechanism 102, an electric-motor stator 103 fixed in position therebelow, and further below the same, a lubricating oil sump 104 for gathering lubricating oil. The compression mechanism 102 comprises: a stationary scroll wrap member 107 having a stationary scroll wrap 106 which is integrally formed on a stationary end plate 105; an orbiting scroll wrap member 110 having an orbiting scroll wrap 108 which is formed on an orbiting end plate 109 and which is engaged with the stationary scroll wrap 106 so as to define a plurality of compression chambers 111; a rotation restraining member 112 which prevents the orbiting scroll wrap member 110 from rotating so as to allow it to make an orbiting movement only; a crankshaft 115 having an eccentric drive shaft 114 which is adapted to cause an orbiting drive shaft 113 provided on the orbiting end plate 109 to make an eccentric orbiting movement; a bearing member 119 having a first and second main shaft bearing 117 and 118 which support a main shaft 116 of the crankshaft 115; etc. Further, a frame body plane 120 on the orbiting-end-plate side of the stationary end plate 105 and an orbiting-end-plate surface 121 on the stationary-end-plate side of the orbiting end plate 109 are so arranged as to slidably abut against each other, and, at the same time, an intermediate pressure hole 122 communicating with the compression chambers 111 is provided in the orbiting end plate 109 so as to keep the pressure in a back-pressure chamber 123 on that side of the orbiting end plate 109 which is opposite to the orbiting scroll wrap 108 at a pressure level which is intermediate between the discharge pressure and the intake pressure. Refrigerant gas, sucked into the compression mechanism 102 through an intake pipe 124 of the compressor, is compressed in the compression chambers 111, and then discharged through a discharge outlet 125. It then passes through a peripheral passage 126 around the compression chambers 111 and is discharged to the exterior of the compressor through a discharge pipe 127. The lubricating oil in the lubricating oil sump 104 is supplied by way of an eccentric oil feeding path 129 extending through the main shaft 116 of the crankshaft 105 and a first branch oil feeding path to the second main shaft bearing 118. That portion of the lubricating oil which flows through the oil feeding path 129 and a second branch oil feeding path 131 passes through an oil groove on the outside of the main shaft 116 and lubricates the first main shaft bearing 117 before it reaches the back-pressure chamber 123. The lubricating oil supplied to the bottom portion 133 of the orbiting drive bearing 113 after passing through the eccentric oil feeding path 129 undergoes pressure reduction in the gap between the eccentric drive shaft 114 and the orbiting drive bearing 113 and is discharged into the back-pressure chamber 123. The lubricating oil which is in the back-pressure chamber 123 passes through the intermediate pressure hole 122, etc. and flows through the compression chambers 111, where it is compressed and discharged out of the compression mechanism along with the refrigerant. That is, all of the lubricating oil which has lubricated the first main shaft bearing 117 and the orbiting drive bearing 113 ultimately enters the compression chambers 111. FIG. 2 is a sectional view showing the structure of the scroll compressor which is disclosed in the specification of U.S. Pat. No. 4,552,518, and FIG. 3 is an enlarged view showing a part of the same. A closed container 201 contains a compression mechanism 202, below which the stator of an electric motor 203 is fixed in position, and, provided further below the same is a lubricating oil sump 204 for gathering lubricating oil. The compression mechanism 202 comprises: a stationary scroll wrap member 207 having a stationary scroll wrap 206 which is integrally formed on a stationary end plate 205; an orbiting scroll wrap member 210 having an orbiting scroll wrap 208 which is formed on an orbiting end plate 209 and which is engaged with the stationary scroll wrap 206 so as to define a plurality of compression chambers 211; a rotation restraining member 212 which prevents the orbiting scroll wrap member 210 from rotating so as to allow it to make an orbiting movement only; a first and a second bearing member 219 and **219*a* which respectively support a first and a second main shaft 216 and 216*a* of a crankshaft 215, which has an eccentric drive bearing 214 that is adapted to cause an orbiting drive shaft 213 provided on the orbiting end plate 209 to make an eccentric orbiting movement; etc. The closed container 201 is divided by a supporting frame body 220 provided in the compression mechanism 202 into an upper section which constitutes an intake chamber 221 where intake pressure is predominant and a lower section which constitutes a discharge space 222 where discharge pressure is predominant. Further, there is provided an annular sealing band 224 which slidably abuts against an orbiting-end-plate back surface 223 on that side of the orbiting end plate 209 which opposite to the orbiting scroll wrap 208 and which divides this orbiting-end-plate back surface 223 into a surface in the central portion upon which the pressure of the discharge gas acts and a surface upon which a pressure lower than the discharge pressure acts. Further, the lubricating oil in the lubricating oil sump 204 is led through an oil feeding capillary tube 225 to an inlet 226 of the compression mechanism 202, and is compressed in the compression chambers 211 together with the refrigerant gas sucked into the compression mechanism 202 through an inlet pipe 211 of the compressor. Afterwards, it is discharged through a discharge hole 228 which is provided in the orbiting drive shaft 213, and is centrifugally separated from the discharged refrigerant gas in an oil separation chamber 229 provided in the crankshaft 215. Then, it passes from the eccentric bearing 214 and by the the vicinity of the orbiting-end-plate back surface 223 and is supplied to the first main shaft bearing 217. Meanwhile, the discharge refrigerant gas having left the oil separation chamber 229 cools the electric motor 203 as indicated by the arrows, and is then discharged out of the compressor through a discharge pipe 230**.

In both of the above-described scroll compressors, a high bearing load is applied to the orbiting drive bearing, the eccentric bearing, the first main shaft bearing, etc., so that a high lubricating-oil flow rate is needed. However, the flow rate at which lubricating oil is supplied to these bearings can only be equal to or lower than the flow rate at which it is supplied to the compression chambers, with the result that lubricating oil is supplied to the compression chambers at an excessive flow rate. However, the lubricating oil sump is situated in the discharge space, so that it is at a high temperature and contains a considerable amount of refrigerant. Accordingly, if lubricating oil enters the compression chambers at an excessive flow rate, the efficiency of the compressor is materially deteriorated by the quantity of heat this lubricating oil possesses and this refrigerant. Suppose, for example, the flow rate at which lubricating oil enters the compression chambers is set at a large value in order to prevent these bearings from being damaged or a large bearing loss from being generated during high speed operation. Then, the flow rate of lubricating oil remains high even when the compressor is being operated at low speed because the flow rate of lubricating oil depends upon the difference between the pressure in the back-pressure chamber and the discharge pressure, with the result that the flow rate of lubricating oil with respect to the discharge amount becomes excessively high, thus materially deteriorating the compressor efficiency. Apart from this, compressors for room air conditioners nowadays are in many cases made in a minimum closed-container body diameter with a view to meeting the demand for a reduction in size and weight, with the stator of the electric motor being directly fixed to the inner wall. In a compressor having such a reduced body diameter, on the other hand, the diameter of the lubricating oil sump is also naturally small, with the result that the height of the lubricating oil level greatly varies depending on the operating condition. In such a case, it is necessary to arrange the discharge pipe at a position spaced away from the lubricating oil sump in order to prevent a large amount of lubricating oil from being taken out from this discharge pipe. Accordingly, in a compressor of the type in which the electric motor is arranged below the compression mechanism and the closed container of which has a relatively small outer diameter, the discharge pipe must be arranged above the electric motor, as in Japanese Patent Publication No. 61-19803 mentioned above. In such a compressor, however, arranging the discharge pipe above the electric motor entails the following the problem: Since the discharge outlet of the compression mechanism is above the electric motor, it takes a very complicated structure to form a discharge-refrigerant-gas passage which will bring the discharged refrigerant upwards again by way of the portion below the electric motor to discharge it out of the compressor through the discharge pipe. In the lubrication system according to Japanese Patent Publication No. 61-19803 mentioned above, the centrifugal force generated by the rotation of the eccentric oil feeding path is rather weak when the rotating speed of the electric motor is low, so that, in some cases, an oil pressure which is high enough to allow the oil to reach the first branch oil feeding path cannot be obtained. In such a case, there is the danger of the refrigerant gas in the discharge space flowing backwards through the bearing gap in the second main shaft bearing or the oil feeding passage into the first-branch oil feeding path, thereby hindering the lubrication. In the case of the example shown in the specification of U.S. Pat. No. 4,552,518 mentioned above, the oil feeding passage leading to the eccentric bearing 214, the end-plate back surface 223, and the first main shaft bearing 217, is filled with a small amount of lubricating oil and a large amount of discharged refrigerant air, which have been separated from each other in the oil separation chamber 229, so that a large amount of gas exist on the high pressure side which is inside the annular sealing band 224. As a result, the sealing effect of the annular sealing band degenerates to allow a large amount of discharged refrigerant gas to leak towards the compression chambers, thereby hindering the normal operation of the compressor, deteriorating the compressor efficiency, etc. Further, even if a large amount of lubricating oil can be supplied to the end surface of the main shaft of the crankshaft in a structure in which an eccentric bearing is arranged inside the main shaft of the crankshaft, as in the specification of U.S. Pat. No. 4,552,518 mentioned above, by an appropriate means different from that of this patent, a high pressure will be generated in that portion of the lubricating oil which is around the outer periphery of the main shaft by the rotation of the end surface of the main shaft when the operating speed of the compressor is high, so that if the oil feeding passage of the main shaft opens there, a large amount of lubricating oil may flow disproportionately through that oil feeding passage, resulting in a shortage in the amount of oil that is fed to the eccentric bearing on the inside.

DISCLOSURE OF INVENTION

The above-mentioned problems in the prior-art scroll compressors described above are solved by a first technical means, according to which a closed container contains an electric motor and a compression mechanism that is driven by the electric motor, the compression mechanism comprising: a stationary scroll wrap member having a stationary scroll wrap which is integrally formed on a stationary end plate; an orbiting scroll wrap member having an orbiting scroll wrap which is formed on an orbiting end plate and which is engaged with the stationary scroll wrap so as to define a plurality of compression chambers; a rotation restraining member which prevents the orbiting scroll wrap member from rotating so as to allow it to make an orbiting movement only; a crankshaft adapted to cause the orbiting scroll wrap member to make an eccentric orbiting movement; and a bearing member which supports a main shaft formed at one end of the crankshaft; discharge gas from the compression mechanism being discharged into a space containing the electric motor and the above-mentioned electric motor, an orbiting drive shaft being formed on that side of the orbiting end plate which is opposite to the orbiting scroll wrap, this orbiting drive shaft being fitted into an eccentric bearing which is arranged eccentric inside the main shaft of the crankshaft, an annular pump ring being provided between the outer periphery of this orbiting drive shaft and an oil-pump-cylinder inner wall provided concentric with respect to the center of the main shaft of this crankshaft, an oil pump partition for division into a suction side and a discharge side being arranged between this pump ring and the oil-pump-cylinder, thus building up an oil pump, a lubricating oil sump being provided in close vicinity to the above-mentioned compression mechanism, an oil intake passage being provided such as to extend from this lubricating oil sump to the suction side of the oil pump, and an oil feeding passage being built up which allows oil feeding to be effected from an oil discharge outlet of this oil pump through an oil discharge chamber to the above-mentioned eccentric bearing or the above-mentioned main shaft bearing.

A second technical means for solving the problems comprises, in addition to the above first technical means, an arrangement in which the oil feeding passage from the oil discharge chamber to the main shaft bearing is allowed to communicate with a main shaft oil groove which is provided in such a manner as to pass by the vicinity of the surface of the above-mentioned orbiting drive shaft and as to extend from the inside of the above-mentioned main shaft to the surface thereof without directly opening into the oil discharge chamber.

A third technical means for solving the problems comprises, in addition to the above first technical means, an arrangement in which the closing of that end surface of the above-mentioned oil pump which is on the side of the orbiting scroll wrap is effected by the orbiting-end-plate back surface on that side of the orbiting end plate which is opposite to the orbiting scroll wrap, and in which provided on the outside of the above-mentioned oil-pump-cylinder inner wall and in close vicinity thereto is an annular sealing band, which divides the orbiting-end-plate back surface into a surface upon which the discharge gas pressure of the above-mentioned oil pump acts and a surface upon which a pressure that is lower than the discharge pressure outside the orbiting end plate acts.

A fourth technical means for solving the problems comprises, in addition to the above first technical means, an arrangement in which there is provided on the surface of the orbiting drive shaft an orbiting-drive-shaft oil groove for feeding oil from the above-mentioned oil discharge chamber to the eccentric bearing. A fifth technical means for solving the problems comprises, in addition to the above-mentioned fourth technical means, an arrangement in which that end portion of the orbiting-drive-shaft oil groove which is on the side communicating with the oil discharge chamber is provided at such a position where it faces the oil discharge outlet when this orbiting drive shaft comes close thereto.

BEST MODE FOR CARRYING OUT THE INVENTION

Figure 1:
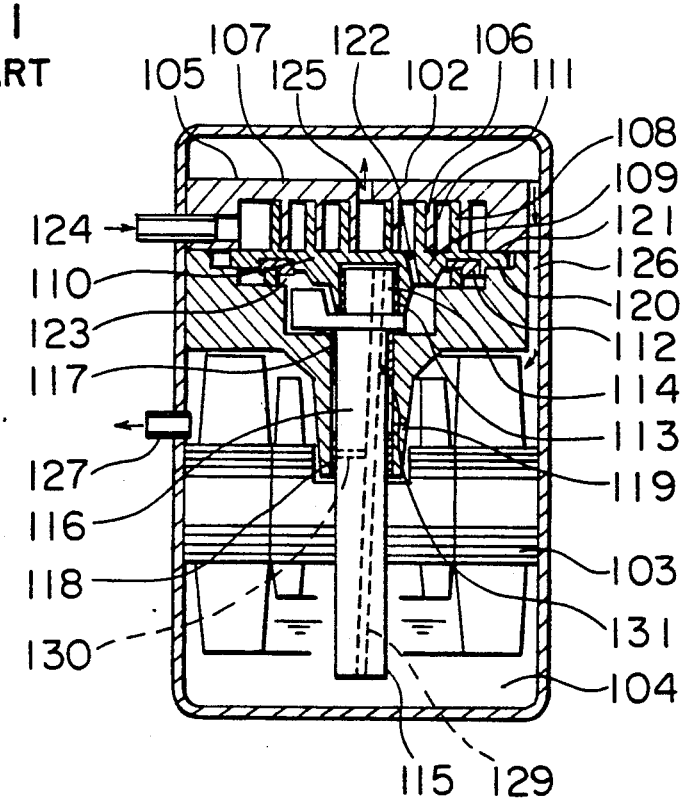
FIG. 1 PRIOR ART
FIGS. 1 through 3 are sectional views of prior-art examples.
Figure 2:
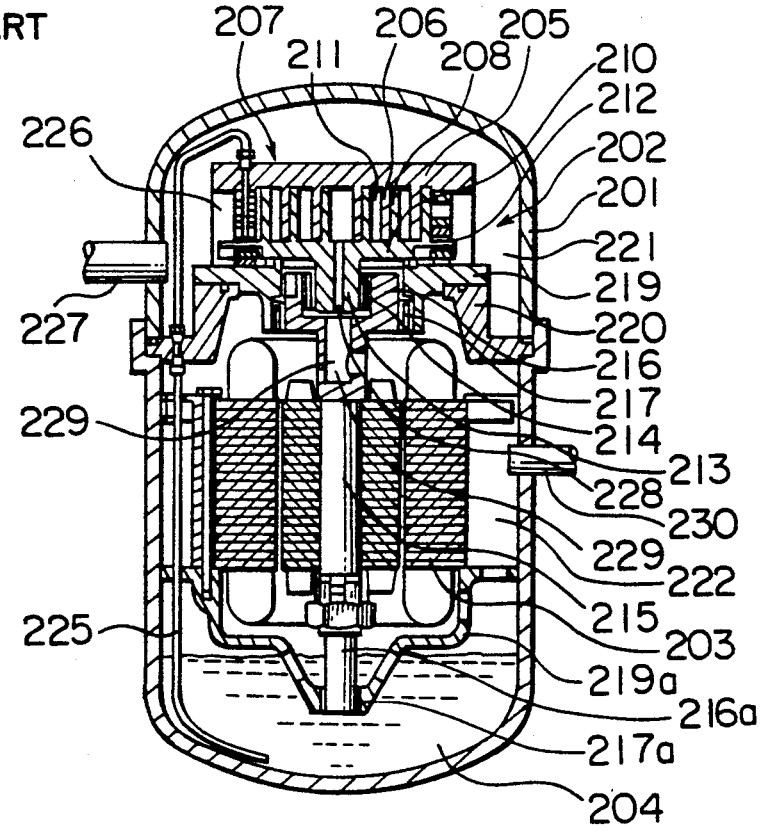
FIG. 2 PRIOR ART
Figure 3:
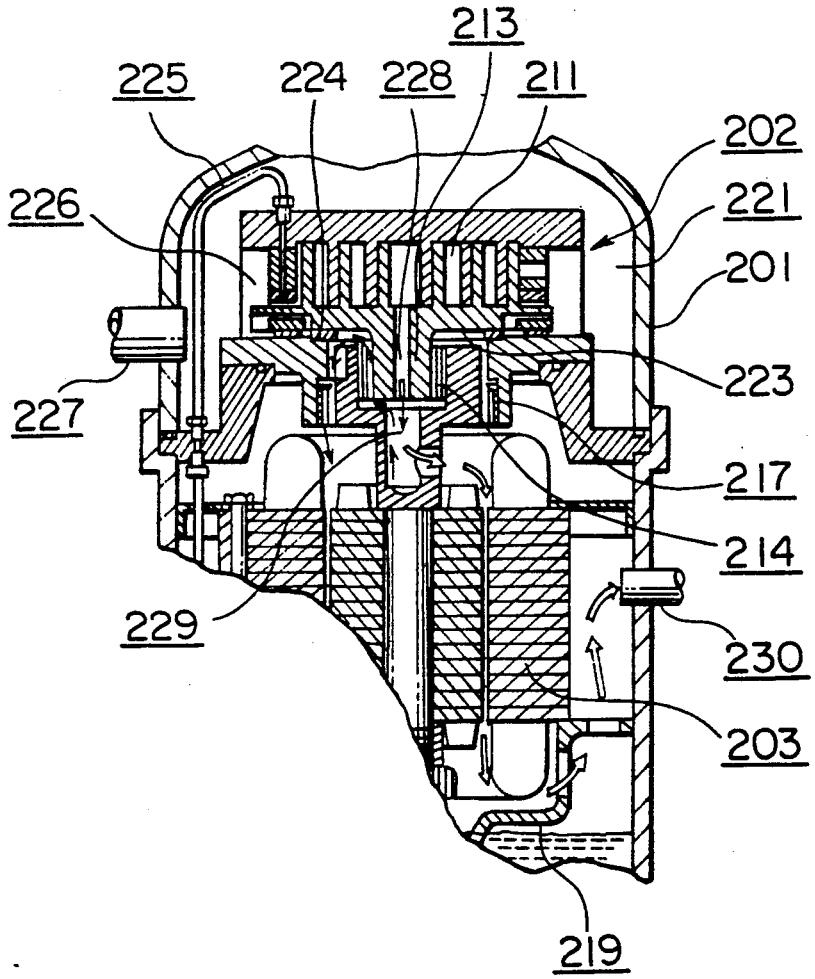
FIG. 3 PRIOR ART
Figure 4:
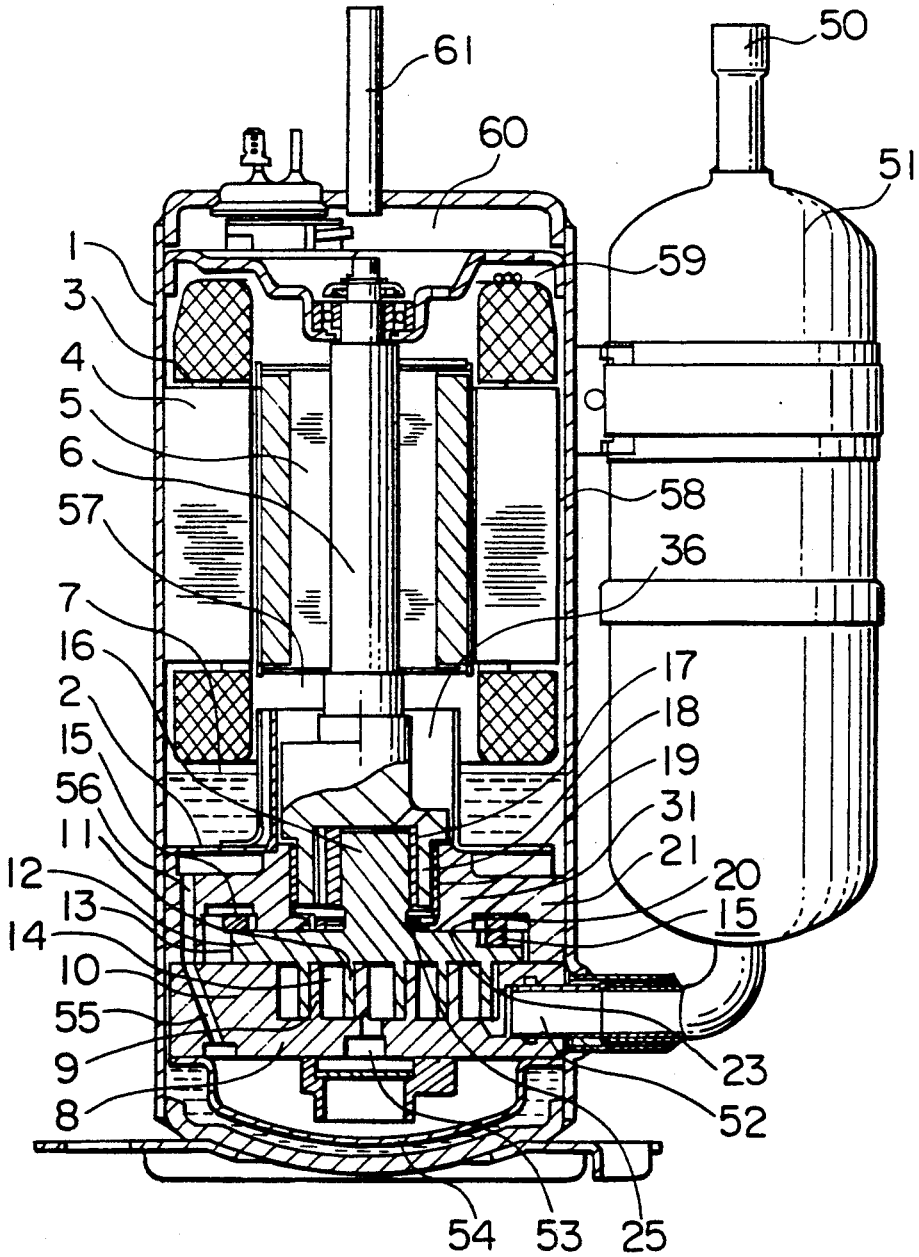
FIG. 4 is a sectional view of a scroll compressor in accordance with an embodiment of the present invention.
Figure 5:
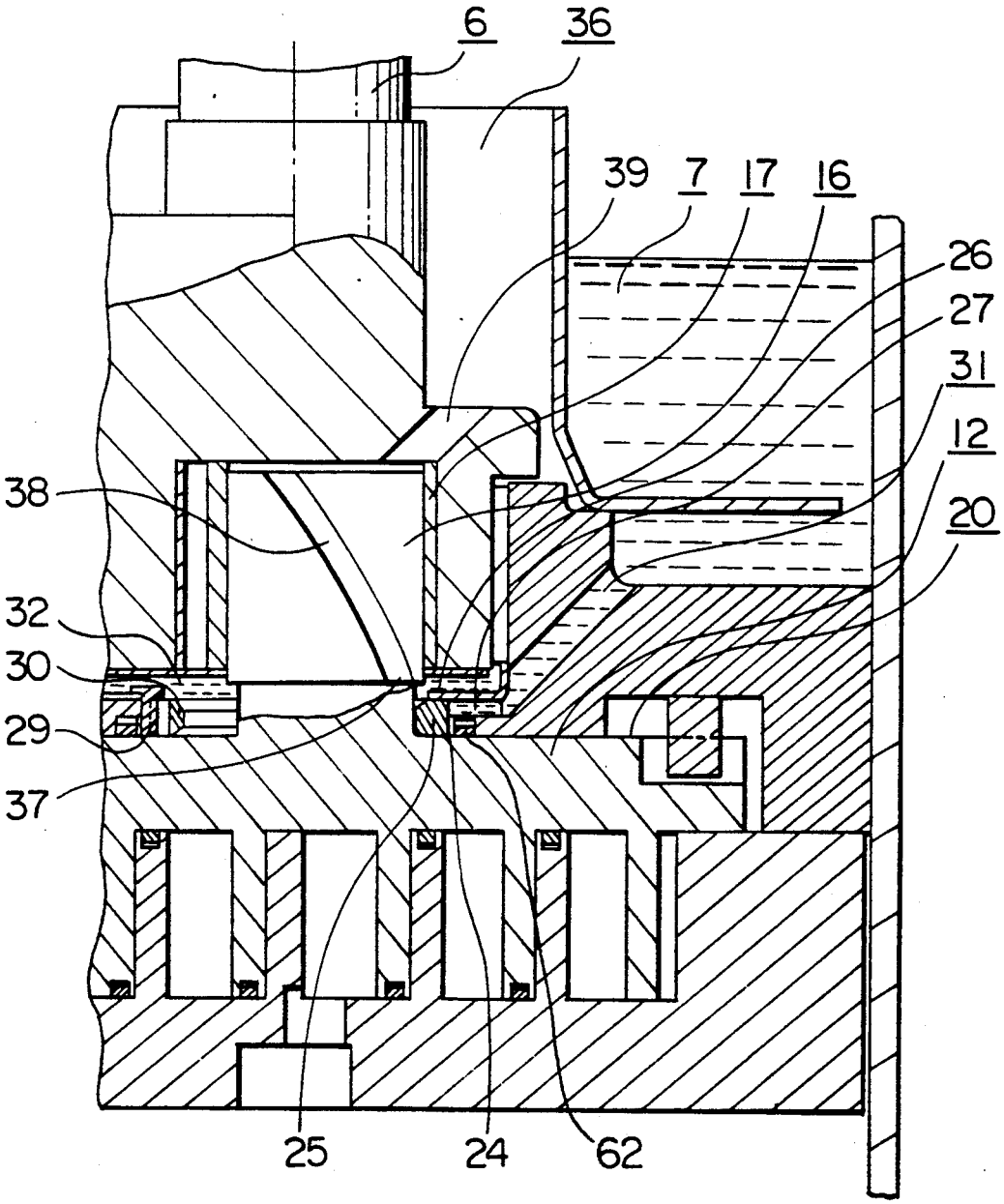
FIGS. 5 and 6 are sectional views showing essential parts of the same.
Figure 6:
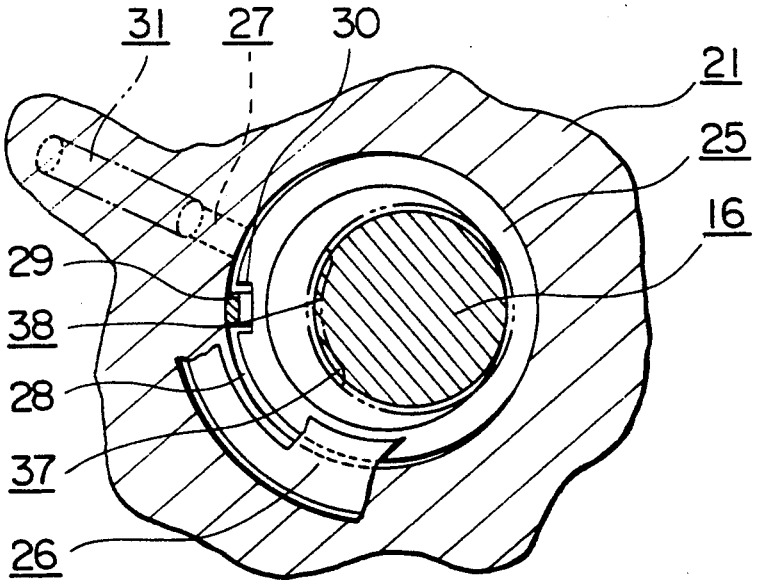
Figure 7A:
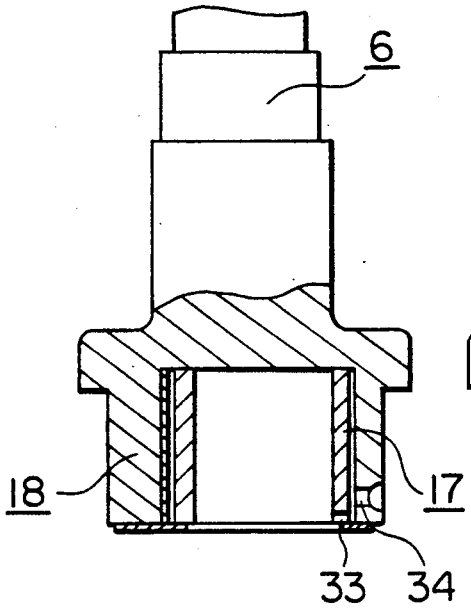
FIGS. 7(*a*) through 7(*c*) are a partially broken away front view, a front view, and a plan view, respectively, showing essential parts of the same.
Figure 7B:
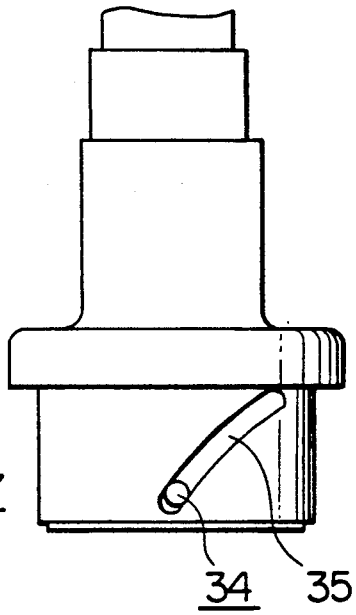
Figure 7C:
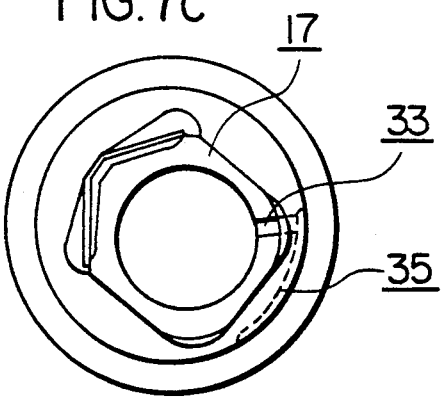

As an embodiment of the present invention, FIG. 4 shows a longitudinal sectional view of a scroll-type electric compressor; FIG. 5 shows a partial enlarged view of the compression mechanism of the same; FIG. 6 shows a detailed sectional view of the oil pump section of the same; and FIG. 7 shows a detail of the oil feeding passage to the main shaft bearing. A compression mechanism 2 is fixed in position in the lower inner section of a closed container 1. Fixed in position above this is the stator 4 of an electric motor 3 for driving this mechanism. A crankshaft 6 for driving the compression mechanism 2 is connected to the rotor 5 of this electric motor 3, and that portion of the lower section of the closed container 1 which is around the compression mechanism 2 is formed as a lubricating oil sump 7. The compression mechanism 2 comprises: a stationary scroll wrap member 10 having a stationary scroll wrap 9 which is integrally formed on a stationary end plate 8; an orbiting scroll wrap member 13 having an orbiting scroll wrap 11 which is formed on an orbiting end plate 12 and which is engaged with the stationary scroll wrap 9 so as to define a plurality of compression chambers 14; a rotation restraining member 15 which prevents the orbiting scroll wrap member 13 from rotating so as to allow it to make an orbiting movement only; an orbiting drive shaft 16 provided on that side of the orbiting end plate 12 which is opposite to the orbiting scroll wrap 11; an eccentric bearing 17 which is provided inside a main shaft 18 of a crankshaft 6 and into which the orbiting drive shaft 16 is fitted; a bearing member 21 having a main shaft bearing 19 supporting the main shaft 18 of the crankshaft 6; and an end-plate-movement restricting surface 23 which is spaced away by a minute gap from an orbiting-end-plate back surface 20 on the back surface of the orbiting end plate 12 and which is adapted to restrict the axial movement of this orbiting scroll wrap member 13. An oil-pump-cylinder inner wall 24 is provided between the main shaft 18 of the crank shaft 6 and the orbiting-end-plate back surface 20. A pump ring 25 is provided between the outer periphery of the orbiting drive shaft 16 and this oil-pump-cylinder inner wall 24. One end of this oil-pump-cylinder inner wall 24 is closed by the orbiting-end-plate back surface 20, and the other end thereof is closed by an oil-pump end plate 26. Provided between the pump ring 25 and the oil-pump-cylinder inner wall 24 is an oil pump partition 29, which divides the oil pump into two regions: the region on the side of an oil suction inlet 27 and that on the side of an oil discharge outlet 28, and this oil pump partition 29 is fitted into an oil-pump-partition groove 30 which is provided on the pump ring 25. Thus, an oil pump is built up. The lubricating oil in the lubricating oil sump 7 is sucked into this oil pump through an oil inlet passage 31 and enters an oil discharge chamber 32 through the oil discharge outlet 28. Part of the lubricating oil in the oil discharge chamber 32 leaves the vicinity of the surface of the orbiting drive shaft 16, and flows by way of main-shaft oil feeding passages 33 and 34. It is then led to an main-shaft oil groove 35 which is provided on the surface of the main shaft in such a manner as not to directly communicate with the oil discharge chamber 32, and, after lubricating the main shaft bearing 19, it is discharged into a balance weight chamber 36. The remaining portion of the oil in the oil discharge chamber 32 passes through an orbiting-drive-shaft oil groove 38, which is formed on the surface of the orbiting drive shaft 16 and which has an orbiting-drive-shaft oil-groove inlet 37 at a position near the oil discharge outlet 28 where it faces the same, and lubricates the eccentric bearing 17. Afterwards, it passes through a lubricating oil discharge outlet 39 of the crank shaft 6 and is discharged into the balance weight chamber 36. Provided on the end-plate-movement restricting surface 23 on the outside of the oil-pump-cylinder inner wall 24 is an annular sealing band 62, which divides the gap between the end-plate-movement restricting surface 23 and the orbiting-end-plate back surface 20 into a surface portion upon which the discharge pressure on the oil pump side acts and a surface portion upon which a pressure lower than the discharge pressure in the outer peripheral section acts. This annular sealing ban 62 is provided in such a manner as to be slidable on the orbiting-end-plate back surface 20. In this embodiment, the pressure in the outer peripheral section of the orbiting-end-plate back surface 20 is at a level which is intermediate between the discharge pressure and the intake pressure. The refrigerant gas, sucked in through an inlet pipe 50 of the compressor, passes through an accumulator 51 and enters the compression mechanism 2 through an inlet 52 thereof. It is then compressed in the compression chambers 14 and flows through a discharge outlet 53, the inside of a discharge muffler 54, a discharge passage 55 provided in the stationary end plate 8, and a discharge passage 56 provided in the bearing member 21. It is then discharged into an under-motor discharge chamber 57 which is provided between the electric motor 3 and the compression mechanism 2. This discharged refrigerant gas passes through a passage 58 in the periphery of the electric motor and a discharge chamber 59 above the electric motor and cools the electric motor 3. Afterwards, it passes through a discharge chamber 60 to be led to the exterior of the compressor through a discharge pipe 61.

INDUSTRIAL APPLICABILITY

The effect obtained by one feature of this invention according to claim 1 is that the flow rate of the lubricating oil supplied to the bearings can be set independently of the flow rate of the lubricating oil supplied to the compression chambers. Moreover, since a displacement-type oil pump of a very simple structure is used and the lubricating oil sump is arranged in the vicinity of the compression mechanism, there is no risk that an obstruction to oil feeding will be caused by a backward flow of discharge gas, etc., thus ensuring a high level of reliability and long service life of the bearings with a small-sized structure and at low cost while retaining the compression efficiency at a high level over a wide range of operating speed. Further, due to the structure in which the lubricating oil sump is arranged, as stated above, in the vicinity of the compression mechanism, the cooling passage for cooling both ends of the electric motor with the discharge refrigerant gas can be formed with ease.

According to another effect obtained by this invention, in addition to the above-noted effect, there is no risk that lubricating oil flow will disproportionately concentrate in the main shaft oil groove, and further, that the lubrication of the main shaft bearing and that of the eccentric bearing can be made perfect by effecting the oil feeding to the main shaft by way of the vicinity of the surface of the orbiting drive shaft.

According to yet another effect obtained by this invention, in addition to the above-cited effects, since lubricating oil is supplied densely to the orbiting-end-plate back surface and the inner periphery of the annular sealing band by means of the oil pump, there is no danger of a large amount of refrigerant gas passing this section to enter the compression chambers, so that the efficiency of the compressor can be maintained at a high level.

According to still another effect obtained by this invention, in addition to the above-discussed effects, the oil feeding to the eccentric bearing is effected through the orbiting-drive-shaft oil groove which is formed on the surface of the orbiting drive shaft adapted to make an orbiting movement, so that no large centrifugal force is applied to the lubricating oil, thus making it possible to reliably effect the oil feeding to the eccentric bearing.

According to a further effect obtained by this invention, in addition to the above-described effects, lubricating oil is discharged into the inlet of the orbiting-drive-shaft oil groove directly in the vicinity of the oil discharge outlet of the oil pump, so that the oil feeding to the eccentric bearing can be effected still more reliably and economically.

What is claimed is:

1. A scroll compressor, comprising:

(a) a closed container;

(b) a compression mechanism disposed in said container and comprising:

(i) a stationary scroll including a stationary end plate and a stationary wrap member integral with said stationary end plate and having a stationary wrap; and (ii) an orbiting scroll including an orbiting end plate, an orbiting wrap member integral with said orbiting end plate and an orbiting wrap integral with a first side of said orbiting end plate, and an orbiting drive shaft formed on a second side of said orbiting end plate opposite to said first side of said orbiting plate on which said orbiting wrap is disposed, said stationary scroll and said orbiting scroll being assembled together such that said stationary wrap and said orbiting wrap are inter-meshed with one another to define a plurality of fluid compression chambers in spaces defined by said stationary and orbiting end plates and said inter-meshed stationary and orbiting wraps;

(c) a motor disposed in said closed container;

(d) a rotation restraining means for preventing said orbiting wrap member from rotating but allowing said orbiting wrap member to undergo orbiting motion relative to said stationary wrap member;

(e) a crank shaft drivable by said motor and including on one end thereof a main shaft having an open hollow region;

(f) an eccentric bearing arranged within said hollow region of said main shaft, said orbiting drive shaft being fitted in said eccentric bearing, whereby when said crank shaft is driven by said motor, said orbiting wrap member is caused to undergo said orbiting motion relative to said stationary wrap member;

(g) a bearing member into which said main shaft of said crank shaft is fitted;

(h) an oil pump including:

(i) an oil pump cylinder inner wall concentric with said main shaft of said crank shaft and disposed around said orbiting drive shaft;

(ii) an annular pump ring disposed between an outer periphery of said orbiting drive shaft and said oil pump cylinder inner wall; and (iii) an oil pump partition arranged between said pump ring and said oil pump cylinder inner wall, said partition dividing said oil pump into a suction side and a discharge side;

(i) a lubricating oil sump disposed within said closed container in close proximity to said compression mechanism;

(j) an oil intake passage extending from said oil sump to said suction side of said oil pump;

(k) an oil discharge chamber disposed in said closed container; and (l) an oil feeding passage extending from said discharge side of said oil pump through said oil discharge chamber and to one of said eccentric bearing and said main shaft bearing.

2. A scroll compressor as in claim 1, wherein said main shaft includes a main shaft oil groove and said oil feeding passage is formed so as to be in fluidic communication with said oil groove, said main shaft oil groove passing near said outer periphery of said orbiting drive shaft and extending from inside said hollow region of said main shaft to an outer peripheral surface of said main shaft without directly opening into said oil discharge chamber.

3. A scroll compressor as in claim 1, wherein said second side of said orbiting end plate includes a back surface for closing an end surface of said oil pump adjacent to a side of said orbiting wrap and wherein said scroll compressor further comprises an annular sealing band disposed in close proximity to and on an outside portion of said oil pump cylinder inner wall, said annular sealing band dividing said back surface of said orbiting end plate into a first surface upon which discharge gas pressure of said oil pump is applied and a second surface upon which a pressure lower than a discharge pressure on an outside of said orbiting end plate is applied.

4. A scroll compressor as in claim 1, wherein said orbiting drive shaft includes on its surface an orbiting drive shaft oil groove, having an end portion in fluid communication with said oil discharge chamber, for feeding oil from said oil discharge chamber to said eccentric bearing.

5. A scroll compressor as in claim 4, wherein said end portion of said orbiting drive shaft oil groove which is in fluid communication with said oil discharge chamber is disposed to face said discharge side of said oil pump when said orbiting drive shaft approaches said discharge side of said oil pump during said orbiting motion.

* * * * *